US008180233B2

(12) United States Patent
Kuroda et al.

(10) Patent No.: US 8,180,233 B2
(45) Date of Patent: May 15, 2012

(54) COOLING DEVICE FOR COOLING THE INSIDE OF AN IMAGE FORMING APPARATUS BY A FAN AND IMAGE FORMING APPARATUS HAVING THE COOLING DEVICE

(75) Inventors: Yoshitaka Kuroda, Ebina (JP); Yutaka Nakayama, Ebina (JP); Masayoshi Nishida, Ebina (JP); Kokichi Kasai, Ebina (JP); Akio Fukuyama, Ebina (JP); Masayuki Okada, Ebina (JP); Kazuyo Ehara, Ebina (JP); Tetsuya Kawatani, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/543,170

(22) Filed: Aug. 18, 2009

(65) Prior Publication Data

US 2010/0158557 A1 Jun. 24, 2010

(30) Foreign Application Priority Data

Dec. 24, 2008 (JP) ..... 2008-328734

(51) Int. Cl.
*G03G 15/00* (2006.01)
*G03G 21/20* (2006.01)

(52) U.S. Cl. ..... 399/43; 399/92; 399/94

(58) Field of Classification Search ..... 399/43, 399/92, 94, 96
See application file for complete search history.

(56) References Cited

U.S. PATENT DOCUMENTS 7,877,038 B2 * 1/2011 Kim et al. ..... 399/92

FOREIGN PATENT DOCUMENTS

| | | |
|---|---|---|
| JP | 08-160680 | 6/1996 |
| JP | 2610119 B | 2/1997 |
| JP | 09-190143 | 7/1997 |

* cited by examiner

*Primary Examiner* — William J Royer
(74) *Attorney, Agent, or Firm* — Morgan, Lewis & Bockius LLP

(57) ABSTRACT

A cooling device that cools the inside of an image forming apparatus provided with a developer carrier that carries an image developed with a developer while being rotated. The cooling device includes: a counting unit that counts an accumulative number of rotation of the developer carrier; and a fan that cools the inside of the image forming apparatus. The cooling device further includes: a calculating unit that calculates an abrasion amount of the developer carrier in which the accumulative number of rotation counted by the counting unit is used as at least one variable; and a controlling unit that actuates the fan with cooling efficiency according to the abrasion amount calculated by the calculating unit.

18 Claims, 3 Drawing Sheets

COOLING DEVICE FOR COOLING THE INSIDE OF AN IMAGE FORMING APPARATUS BY A FAN AND IMAGE FORMING APPARATUS HAVING THE COOLING DEVICE

CROSS-REFERENCE TO RELATED APPLICATION

This application is based on and claims priority under 35 USC 119 from Japanese Patent Application No. 2008-328734, filed Dec. 24, 2008.

BACKGROUND (i) Technical Field

The present invention relates to a cooling device and an image forming apparatus.

(ii) Related Art

Image forming apparatuses such as mainly a printer and a copying machine have been conventionally widely used. In most image forming apparatuses, a fan for cooling the inside of the image forming apparatus is provided to avoid an increase in temperature inside of the image forming apparatus and the fan cools the inside of the image forming apparatus during image formation.

SUMMARY

According to an aspect of the invention, there is provided a cooling device that cools the inside of an image forming apparatus provided with a developer carrier that carries an image developed with a developer while being rotated, the cooling device including:

a counting unit that counts an accumulative number of rotation of the developer carrier;

a fan that cools the inside of the image forming apparatus;

a calculating unit that calculates an abrasion amount of the developer carrier in which the accumulative number of rotation counted by the counting unit is used as at least one variable; and a controlling unit that actuates the fan with cooling efficiency according to the abrasion amount calculated by the calculating unit.

BRIEF DESCRIPTION OF THE DRAWINGS

An exemplary embodiment of the present invention will be described in detail based on the following figures, wherein.

DETAILED DESCRIPTION

An exemplary embodiment according to the present invention is described below with reference to the attached drawings.

Figure 1:
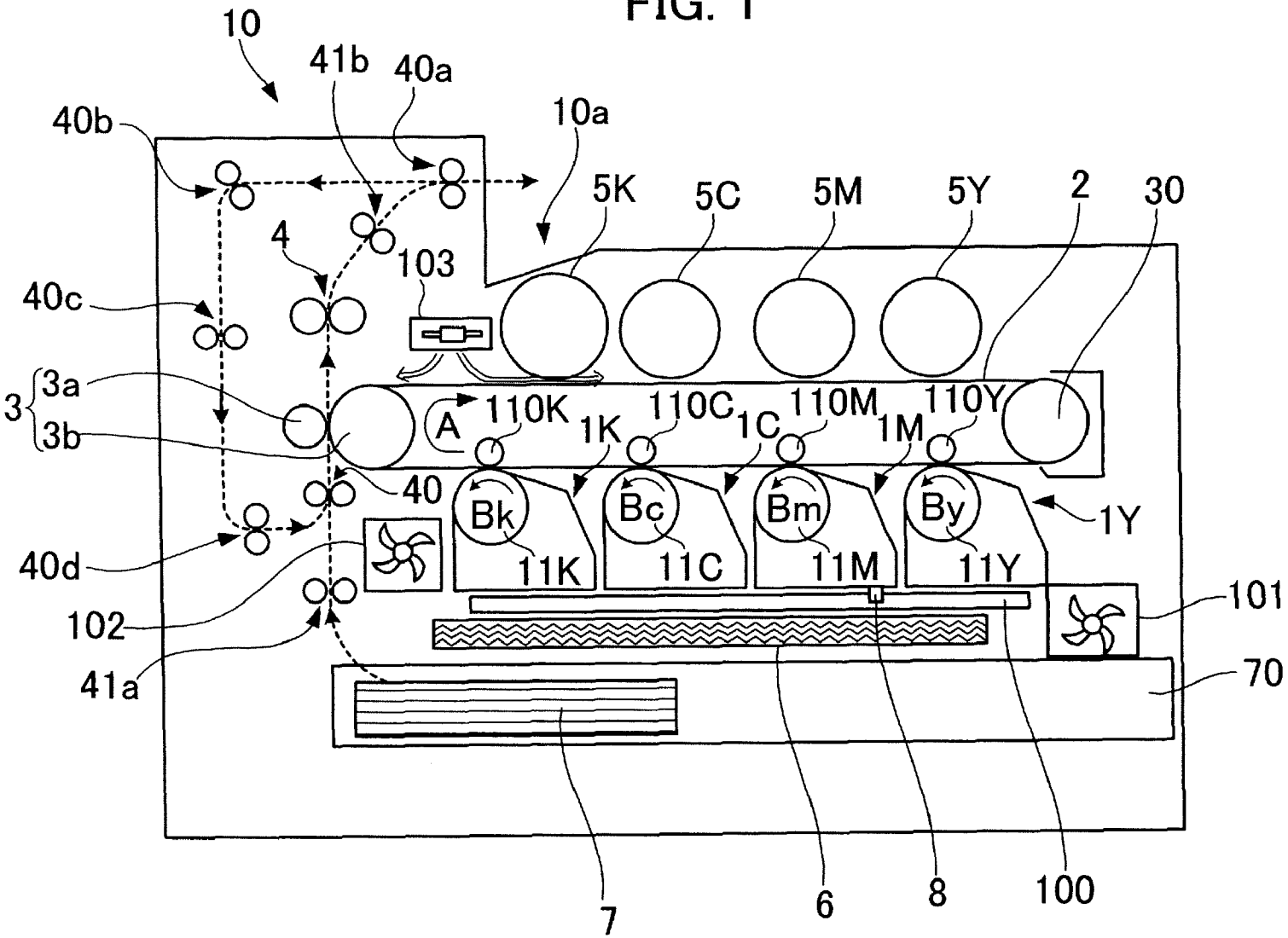
FIG. 1 is a view showing the general constitution of an image forming apparatus according to an exemplary embodiment.

FIG. 1 is a view showing the general constitution of an image forming apparatus 10 in the present exemplary embodiment.

The image forming apparatus 10 in the present exemplary embodiment is a double-sided outputting color printer.

The image forming apparatus 10 is provided with image forming units 1K, 1C, 1M, and 1Y for forming images of black (K), cyan (C), magenta (M), and yellow (Y) colors. The image forming units 1K, 1C, 1M, and 1Y include laminated-type developer carriers 11K, 11C, 11M, and 11Y of an electrophotographic system, respectively, which are rotated in directions indicated by arrows Bk, Bc, Bm, and By in FIG. 1, respectively. On the developer carriers 11K, 11C, 11M, and 11Y in the image forming units 1K, 1C, 1M, and 1Y, development images are formed with developers containing toners of colors corresponding to the image forming units 1K, 1C, 1M, and 1Y, respectively. Here, the image forming units 1K, 1C, 1M, and 1Y shown in FIG. 1 include the same constituent elements, although the colors of toners used in forming the development images are different from each other. The configurations of the image forming units 101, 102, and 103 are explained below.

Figure 2:
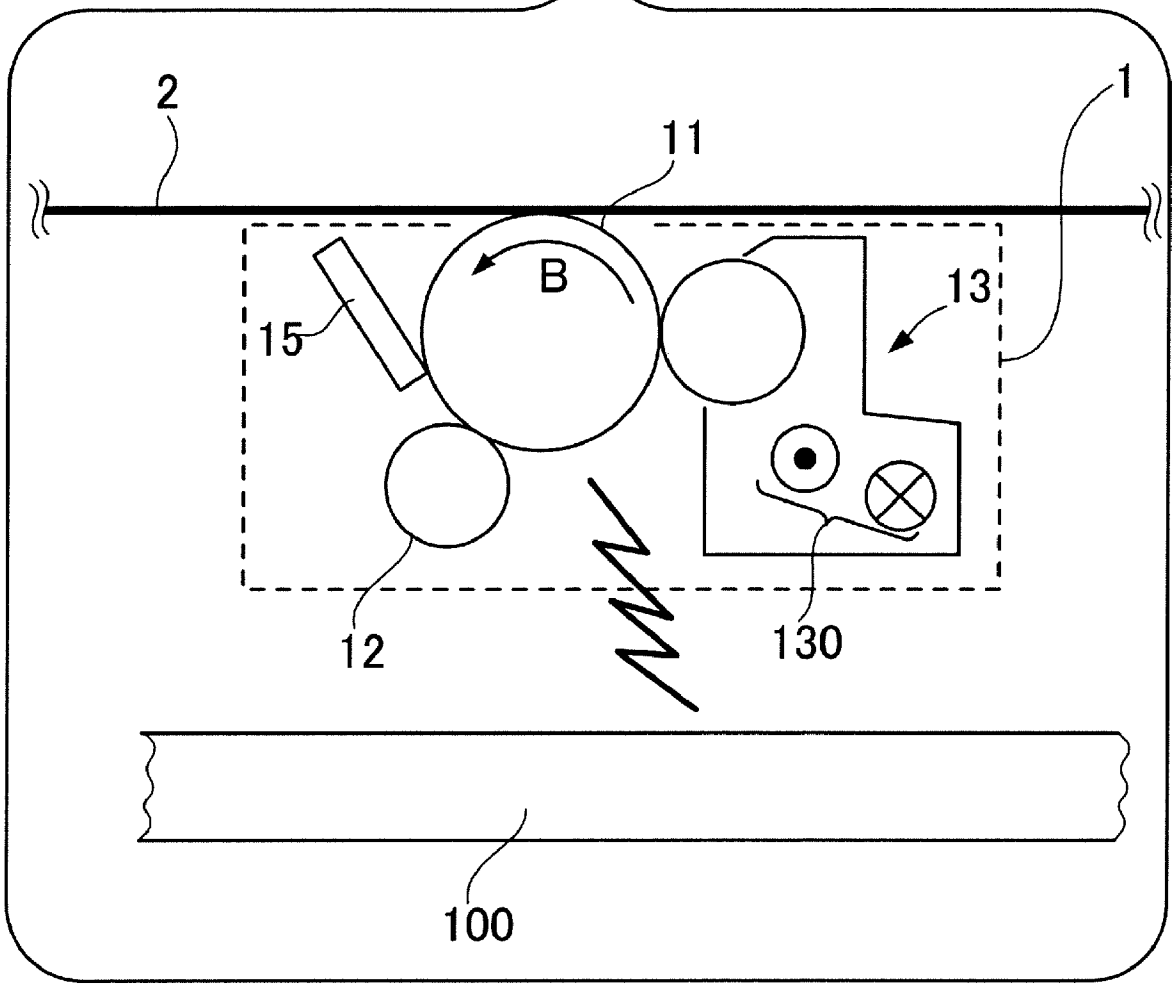
FIG. 2 is a view showing the configuration of an image forming unit shown in FIG. 1.

FIG. 2 is a view showing the configuration of the image forming units 1K, 1C, 1M, and 1Y, shown in FIG. 1.

An image forming unit 1 shown in FIG. 2 represents the image forming units 1K, 1C, 1M, and 1Y shown in FIG. 1. Similarly, a developer carrier 11 shown in FIG. 2 represents the developer carriers 11K, 11C, 11M, and 11Y shown in FIG. 1.

The developer carrier 11 shown in FIG. 2 is rotated in a direction indicated by an arrow B in FIG. 2 by a mechanism, not shown. A charger 12, a developing device 13, and a cleaning blade 15 are disposed around the developer carrier 11. The image forming unit 1 is constituted of the developer carrier 11, the charger 12, the developing device 13, and the cleaning blade 15. The same developer carrier 11, charger 12, developing device 13, and cleaning blade 15 are provided in each of the image forming units 1K, 1C, 1M, and 1Y shown in FIG. 1.

The developer carrier 11 is rotated in the direction indicated by the arrow B in FIG. 2 (which is the direction representing the directions indicated by the arrows Bk, Bc, Bm, and By in FIG. 1). The charger 12 is brought into contact with the developer carrier 11, to be rotated while following the rotation of the developer carrier 11, thereby electrically charging the developer carrier 11. The electric charging by the charger 12 allows the surface of the developer carrier 11 to have a predetermined potential. Here, the electric charging is performed by adopting a way in which the developer carrier 11 is electrically charged by a charge voltage obtained by superimposing an AC voltage on a DC voltage. Under the image forming unit 1 shown in FIG. 2 is disposed an exposing unit 100 for forming an electrostatic latent image having a potential different from an ambient potential on the developer carrier 11 by irradiation with a laser beam toward the electrically charged developer carrier 11. The developing device 13 electrostatically attaches a developer containing a charged toner to the electrostatic latent image so as to develop it. In this manner, a development image is formed on the developer carrier 11. Here, two augers 130 which are rotated in directions reverse to each other around rotary axes in a vertical direction in FIG. 2 are housed inside of the developing device 13. The augers 130 carry the developer in the directions reverse to each other in the vertical direction in FIG. 2 while agitating the developer. The toner contained in the developer is electrically charged during being carried. The electrically charged toner is used in developing the electrostatic latent image. In the meantime, an intermediate transfer belt 2 which is moved in a direction indicated by an arrow A in FIG. 1 in contact with the developer carrier 11 is disposed above the image forming unit 1 shown in FIG. 2. The intermediate transfer belt 2 is adapted to convey a primary transfer image after the development image formed on the developer carrier 11 is (primarily) transferred. The cleaning blade 15 has the function of removing the toner remaining on the developer carrier 11 after the primary transfer.

The configuration of the image forming unit 1 is as described above. Returning to FIG. 1, the explanation is continuously made below on the image forming apparatus 10.

The image forming apparatus 10 shown in FIG. 1 includes a pair of secondary transfer rolls 3 for secondarily transferring, on a sheet 7, the primary transfer image formed on the intermediate transfer belt 2 and a fixing device 4 for fixing, on the sheet 7, a not-fixed secondary transfer image transferred onto the sheet 7 in addition to the above-described image forming units 1K, 1C, 1M, and 1Y, intermediate transfer belt 2, and exposing unit 100. The image forming apparatus 10 further includes four toner cartridges 5K, 5C, 5M, and 5Y for supplying the toners of black (K), cyan (C), magenta (M), and yellow (Y) colors to the image forming units 1K, 1C, 1M, and 1Y by mechanisms, not shown, respectively, a tray 70 having sheets 7 stacked therein, and a drive roll 30 for driving the intermediate transfer belt 2. The intermediate transfer belt 2 is circularly moved in the direction indicated by the arrow A in FIG. 1 in the state in which it is stretched between a first secondary transfer roll 3*b* and the drive roll 30 while receiving drive force from the drive roll 30. The intermediate transfer belt 2 is pressed against a second secondary transfer roll 3*a* by the first secondary transfer roll 3*b*. The secondary transfer roll pair 3 includes the first secondary transfer roll 3*b* and the second secondary transfer roll 3*a*.

Moreover, the image forming apparatus 10 includes a power source board 6 for supplying electric power to each of the constituent elements such as the fixing device 4 and the four image forming units 1K, 1C, 1M, and 1Y in the image forming apparatus 10, a temperature sensor 8 for measuring a temperature inside of the image forming apparatus 10, and three cooling fans, that is, a first fan 101, a second fan 102, and a third fan 103. Among the constituent elements which receive the electric power from the power source board 6, the charger 12 (see FIG. 2) disposed inside of each of the image forming units 1K, 1C, 1M, and 1Y needs a high voltage for electric charging. Therefore, a great quantity of electric power is supplied to the charger 12 (see FIG. 2). The power source board 6 is liable to generate heat in supplying the electric power. The first fan 101 out of the three fans is responsible for cooling mainly the power source board 6. The residual second and third fans 102 and 103 are responsible for cooling the entire inside of the image forming apparatus 10. The three fans 101, 102, and 103 also are rotated upon receipt of the electric power from the power source board 6. As the received voltage is higher, the fans 101, 102, and 103 are rotated at a higher speed to exhibit a more excellent cooling efficiency. The image forming apparatus 10 is provided with a control board, although not shown in FIG. 1, for controlling not only the supply of the electric power from the power source board 6 but also the constituent elements housed inside of the image forming apparatus 10. As a consequence, the control board controls the rotations of the three fans 101, 102, and 103. The control board is described later.

Next, explanation is made below of an image forming operation in the image forming apparatus 10.

First of all, the developer carriers 11K, 11C, 11M, and 11Y inside of the four image forming units 1K, 1C, 1M, and 1Y are electrically charged by the chargers 12 (see FIG. 2) inside of the image forming units 1K, 1C, 1M, and 1Y, respectively. Subsequently, the electrically charged developer carriers 11K, 11C, 11M, and 11Y are irradiated with the laser beams by the exposing unit 100, so that the electrostatic latent images of the colors are formed on the developer carriers 11K, 11C, 11M, and 11Y inside of the image forming units 1K, 1C, 1M, and 1Y, respectively. The formed electrostatic latent images are developed with the developers containing the toners of the colors corresponding to the image forming units 1K, 1C, 1M, and 1Y by the developing devices 13 (see FIG. 2) inside of the image forming units 1K, 1C, 1M, and 1Y, thereby forming the respective development images of the colors. The development images of the colors formed in the image forming units 1K, 1C, 1M, and 1Y, respectively, are (primarily) transferred in sequence in superimposition in the order of yellow (Y), magenta (M), cyan (C), and black (K) colors on the intermediate transfer belt 2 at positions of primary transfer rolls 110K, 110C, 110M, and 110Y corresponding to the developer carriers 11K, 11C, 11M, and 11Y, respectively, resulting in a multi-color primary transfer image. The multi-color primary transfer image is conveyed to the secondary transfer roll pair 3 by the intermediate transfer belt 2. In the meantime, the sheet 7 stacked in the tray 70 is taken out in line with the formation of the multi-color primary transfer image, and then, is fed by a first feeding roll pair 41*a*, and further, the sheet 7 is registered by a registering roll pair 40. The multi-color primary transfer image is (secondarily) transferred onto the fed sheet 7 by the secondary transfer roll pair 3, and further, the resultant secondary transfer image formed on the sheet 7 is subjected to fixing by the fixing device 4. In FIG. 1, a sheet feed path at this time is indicated by an upward dotted arrow.

In the case of single-sided image formation of the sheet 7, the sheet 7 passes the sheet feed path only once, to be fixed with the secondary transfer image in the fixing device 4, and then, is discharged onto a discharge tray 10*a* as it is passed through a second feeding roll pair 41*b* and a discharging roll pair 40*a*, as indicated by a rightward dotted arrow in FIG. 1.

In contrast, in the case of double-sided image formation of the sheet 7, the secondary transfer image is transferred and fixed to one surface of the sheet 7 through the sheet feed path indicated by the upward arrow, and then, the sheet 7 is not discharged onto the discharge tray 10*a* but returns back and passes through a first double-sided feeding roll pair 40*b* to be fed downward on a path indicated by a downward dotted arrow. Thereafter, the sheet 7 passes a second double-sided feeding roll pair 40*c*, and then, is turned upward in a third double-sided feeding roll pair 40*d* to pass again toward the secondary transfer roll pair 3. During a period after the sheet 7 is subjected to the transfer by the secondary transfer roll pair 3 at the first time till the sheet 7 reaches the secondary transfer roll pair 3 again, another multi-color primary transfer image is formed on the intermediate transfer belt 2 by the above-described way. When the sheet 7 reaches the secondary transfer roll pair 3 at the second time, the multi-color primary transfer image is secondarily transferred onto a side reverse to the side subjected to the secondary transfer at the first time. The resultant secondary transfer image formed on the reverse side is fixed by the fixing device 4, and then, the sheet 7 having the images fixed on both sides thereof is discharged onto the discharge tray 10*a*.

The image forming operation in the image forming apparatus 10 has been described above.

In the image forming apparatus 10 shown in FIG. 1, the four developer carriers 11K, 11C, 11M, and 11Y are incorporated inside of the image forming apparatus 10, and then, a number of rotation accumulated after the start of the use (hereinafter simply referred to as an accumulative number of rotation) is counted, and further, an abrasion amount of each of the developer carriers 11K, 11C, 11M, and 11Y is calculated based on each of the accumulative numbers of rotation.

According to a maximum one of the four abrasion amounts of the four developer carriers 11K, 11C, 11M, and 11Y (e.g., the abrasion amount of the developer carrier 11K for the black color if the abrasion amount of the developer carrier 11K for the black color is maximum), the first fan 101, the second fan 102, and the third fan 103 shown in FIG. 1 are driven such that a more excellent cooling efficiency may be exhibited as the maximum abrasion amount is greater.

Although explanation is made below on the assumption that the three fans 101, 102, and 103 are controlled according to the maximum one of the abrasion amounts of the four developer carriers 11K, 11C, 11M, and 11Y, other ways of control may be adopted by changing a control program on the control board in the image forming apparatus 10. For example, a control program may be changed to that of a way of control in which the three fans 101, 102, and 103 are controlled according to an average of the abrasion amounts of the four developer carriers 11K, 11C, 11M, and 11Y, or of a way of control in which the three fans 101, 102, and 103 are controlled according to the abrasion amount of the developer carrier 11K for the black color which is most frequently used.

Here, a description is given of the first fan 101, the second fan 102, and the third fan 103 shown in FIG. 1.

Figure 3:
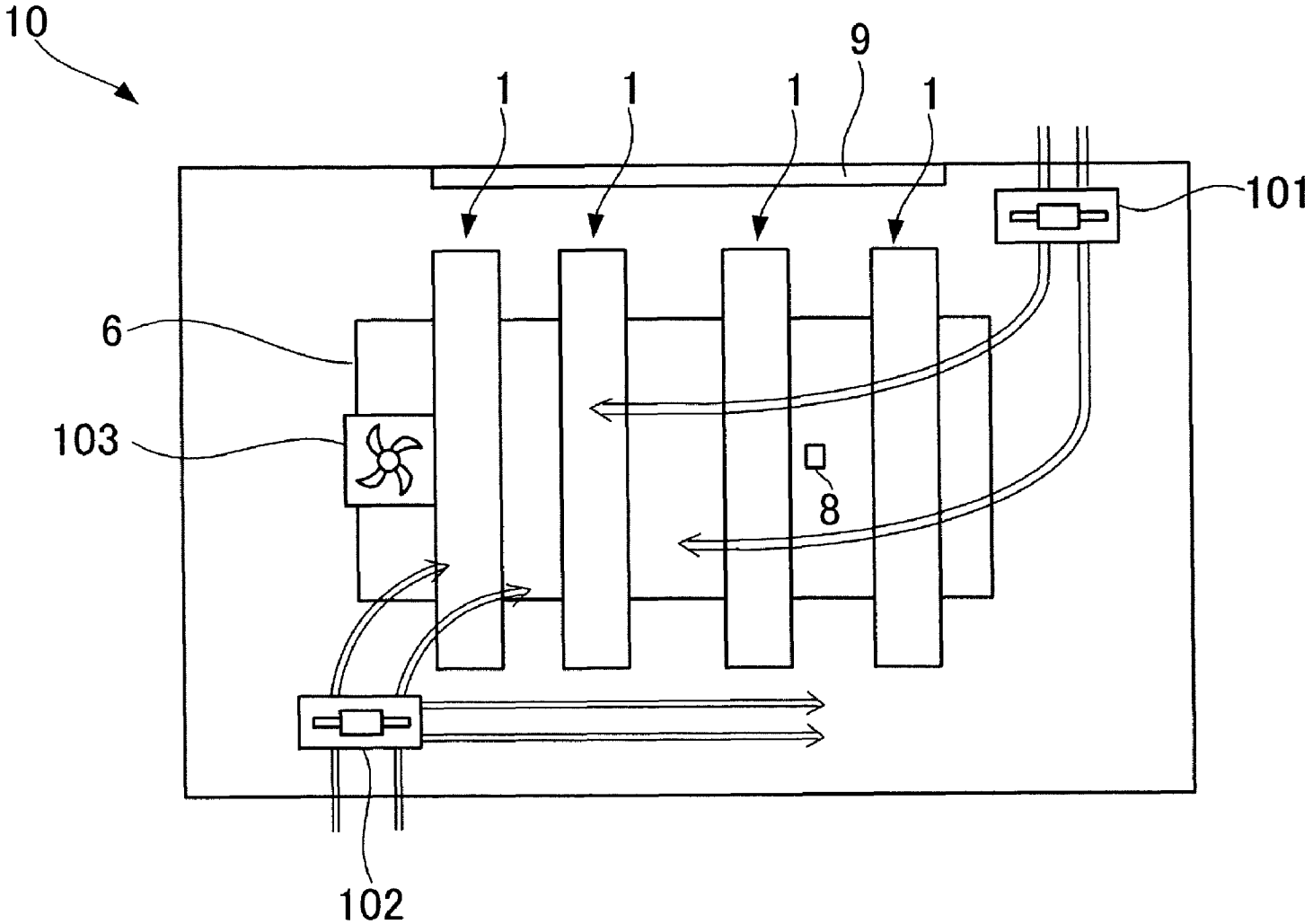
FIG. 3 is a view showing the arrangement of a first fan, a second fan, and a third fan.

FIG. 3 is a view showing the arrangement of the first fan 101, the second fan 102, and the third fan 103.

FIG. 3 shows the arrangement of the first fan 101, the second fan 102, and the third fan 103 when the image forming apparatus 10 is viewed from the upper side of the image forming apparatus 10 shown in FIG. 1. In FIG. 3, an air flow generated by the rotation of the first fan 101 and an air flow generated by the rotation of the second fan 102 are indicated by heavy arrows. As indicated by the heavy arrows, the first fan 101 takes air into the image forming apparatus 10 from the upper right in FIG. 3, and then, sends the air toward mainly the power source board 6, to cool it. In the meantime, the second fan 102 takes air into the image forming apparatus 10 from the lower left in FIG. 3, and then, sends the air rightward and upward of the second fan 102 in FIG. 3, to cool the entire inside of the image forming apparatus 10. Meanwhile, the third fan 103 takes air from the outside of the image forming apparatus 10 through ducts, not shown, in FIGS. 1 and 3, sends the air in directions indicated by heavy arrows in FIG. 1, to cool the entire inside of the image forming apparatus 10.

FIG. 3 shows the above-described control board 9 which controls each of the constituent elements, inclusive of the three fans 101, 102, and 103, disposed inside of the image forming apparatus 10. In controlling the three fans 101, 102, and 103, the control board 9 switchably controls the first fan 101 on two stages of low-speed rotation and high-speed rotation, whereas it switchably controls the second fan 102 and the third fan 103 on two stages of rotation and non-rotation. As described above, the rotational speed of each of the fans 101, 102, and 103 is determined according to the voltage applied to each of the fans 101, 102, and 103. The control of each of the fans on the two stages is specifically performed, as follows: the control board 9 selects a first predetermined voltage or a second predetermined voltage higher than the first predetermined voltage as a drive voltage for the first fan 101, to control the first fan 101; whereas the control board 9 supplies or stops to supply a third predetermined voltage and a fourth predetermined voltage to the second fan 102 and the third fan 103, respectively, to control the second fan 102 and the third fan 103.

Here, the control board 9 serves the functions of counting the accumulative numbers of rotation of the developer carriers 11K, 11C, 11M, and 11Y, calculating the abrasion amounts of the developer carriers 11K, 11C, 11M, and 11Y based on the accumulative number of rotation, and determining the maximum abrasion amount. In the present exemplary embodiment, the control board 9 represents a member serving as all of a counter, a calculator, and a controller. The control board 9 and the three fans 101, 102, and 103 exemplify the cooling device according to the present invention.

A detailed description is given below of the operation of the control board 9 for cooling the inside of the image forming apparatus 10.

During a period when the power source is turned on in the image forming apparatus 10, the control board 9 acquires information on the temperature inside of the image forming apparatus 10 from the temperature sensor 8 all the time. Moreover, the control board 9 gets the number of rotation of each of the developer carriers 11K, 11C, 11M, and 11Y when the image is formed. At this time, the control board 9 gets also information on whether each of the rotating developer carriers 11K, 11C, 11M, and 11Y is electrically charged by the charger 12 (see FIG. 2) in contact with each of the developer carriers 11K, 11C, 11M, and 11Y or the electric charging by the charger 12 (see FIG. 2) is stopped. And then, the control board 9 counts the accumulative numbers of rotation after the start of the use of each of the developer carriers 11K, 11C, 11M, and 11Y individually with respect to the rotation of each of the developer carriers 11K, 11C, 11M, and 11Y in the electrically charged state and the rotation of each of the developer carriers 11K, 11C, 11M, and 11Y in the stopped state of the electric charging. Here, the rotation of each of the developer carriers 11K, 11C, 11M, and 11Y in the stopped state of the electric charging specifically signifies an idle rotation for adjustment immediately before and after the image formation (i.e., rotation irrespective of the image formation) or an idle rotation when one of the developer carriers 11K, 11C, 11M, and 11Y which corresponds to the color, which is not used for the image formation, rotationally follows the drive of the intermediate transfer belt 2 during the image formation.

The control board 9 individually counts the accumulative numbers of rotation in the electrically charged state and in the stopped state of the electric charging in the above-described manner because a larger frictional coefficient between the developer carrier 11 (see FIG. 2) and the charger 12 (see FIG. 2) in the state in which the developer carrier 11 (see FIG. 2) is electrically charged than that in the state in which the electric charging is stopped is liable to induce the advance in the abrasion, and therefore, attribution to the abrasion amount needs to be individually considered in the above-described two electrically charged states. The consideration of the attribution to the abrasion amounts by individually counting the accumulative numbers of rotation in the two electrically charged states enhances the calculative accuracy of the abrasion amount more than in the way in which the accumulative numbers of rotation are counted irrelevantly to the two electrically charged states and the abrasion amount is calculated based on the accumulative numbers of rotation. Incidentally, the change in frictional coefficient according to the above-described electrically charged state is induced by a change on the developer carrier 11 (see FIG. 2) (i.e., a sputtering effect) according to adhesion of a discharged product or a toner particle onto the developer carrier 11 (see FIG. 2).

The control board 9 calculates an abrasion amount W (unit: pm, or picometer) of each of the four developer carriers 11K, 11C, 11M, and 11Y by an equation below based on the temperature inside of the image forming apparatus 10, the accumulative number of rotation of each of the developer carriers 11K, 11C, 11M, and 11Y in the electrically charged state, and the accumulative number of rotation of each of the developer carriers 11K, 11C, 11M, and 11Y in the stopped state of the electric charging.

$$W=(r_1w_1+r_2\times w_2)\times k \quad (1)$$

The abrasion amount W determined by the equation (1) indicates an estimate of the degree of the abrasion at the surface of the developer carrier 11 (see FIG. 2). In the equation, $r_1$ is the accumulative number of rotation of the developer carrier 11 (see FIG. 2) in the state in which the developer carrier 11 (see FIG. 2) is electrically charged; and $r_2$ is the accumulative number of rotation of the developer carrier 11 (see FIG. 2) in the state in which the electric charging is stopped. In addition, $w_1$ and $w_2$ are constants representing the abrasion amount of the developer carrier 11 (see FIG. 2) when the developer carrier 11 (see FIG. 2) is rotated once; and k is a value determined according to the temperature inside of the image forming apparatus 10. Here, $w_1$, $w_2$ and k are obtained from an experiment in which the degree of the abrasion is actually measured by rotating the developer carrier 11 (see FIG. 2). As described above, the abrasion of the developer carrier is liable to advance in the electrically charged state of the developer carrier 11 (see FIG. 2) more than in the stopped state of the electric charging. In consideration of this, $w_1$ is larger than $w_2$.

The control board 9 compares a maximum one out of the abrasion amounts W of the four developer carriers 11K, 11C, 11M, and 11Y calculated in accordance with the equation (1) with a predetermined threshold. As described above, the electrically charging power for the developer carrier 11 (see FIG. 2), to be supplied to the charger 12 (see FIG. 2) by the power source board 6 for electrically charging the developer carrier 11 (see FIG. 2) is increased according to the abrasion of the developer carrier 11 (see FIG. 2). The predetermined threshold is equal to an abrasion amount of the developer carrier 11 (see FIG. 2) when a heat generation amount of the power source board 6 becomes a dangerous level from the viewpoint of a high temperature inside of the image forming apparatus 10 due to the electrically charging power reaching a predetermined value. The control board 9 controls the cooling efficiency of the three fans 101, 102, and 103 by a way shown in Table 1 below according to whether or not the maximum abrasion amount W exceeds the threshold.

TABLE 1

| | | Small abrasion amount | | Large abrasion amount | |
|---|---|---|---|---|---|
| | Purpose | Single-sided output | Double-sided output | Single-sided output | Double-sided output |
| 1st fan | To cool power source board | Rotation at low speed | Rotation at high speed | Rotation at high speed | Rotation at high speed |
| 2nd fan | To cool inside of apparatus | No rotation | Rotation | Rotation | Rotation |
| 3rd fan | To cool inside of apparatus | No rotation | Rotation | No rotation | Rotation |

In Table 1 above, the control contents when the abrasion amount W is the threshold or smaller are written in a column of "small abrasion amount:" in contrast, the control contents when the abrasion amount W exceeds the threshold is written in a column of "large abrasion amount."

Here, a load exerted on the power source board 6 is particularly large when a user designates a job of double-sided outputting in the image forming apparatus 10. Therefore, the heat generation amount of the power source board 6 is liable to become the dangerous level from the viewpoint of the high temperature inside of the image forming apparatus 10 even in a situation in which the abrasion of the developer carrier does not advances so much. In view of this, the control board 9 and the entire inside of the image forming apparatus 10 are cooled in the way in which the three fans 101, 102, and 103 are used to the maximum irrespective of the abrasion of the developer carrier in the case of the double-sided outputting in the image forming apparatus 10. That is to say, the control board 9 controls the power source board 6 to allow the first fan 101 to be rotated at a high speed at the second predetermined voltage whereas the second fan 102 and the third fan 103 to be rotated at the third predetermined voltage and the fourth predetermined voltage, respectively, in the case of the double-sided outputting, as shown in Table 1.

In contrast, a load exerted on the power source board 6 is not large very much when the user designates a job of a single-sided outputting as long as the maximum abrasion amount W is the threshold or smaller. As a consequence, the control board 9 controls the first fan 101 to be rotated at a low speed at the first predetermined voltage whereas the control board 9 maintains the second fan 102 and the third fan 103 in a non-rotational state, as shown in Table 1. Even in the case of the single-sided outputting, when the maximum abrasion amount W exceeds the threshold, the heat generation amount of the power source board 6 is liable to reach the dangerous level from the viewpoint of the high temperature inside of the image forming apparatus 10. In view of this, even in the case of the job of the single-sided outputting, the control board 9 controls the first fan 101 to be rotated at the high speed at the second predetermined voltage whereas the second fan 102 to be rotated at the third predetermined voltage when the maximum abrasion amount W exceeds the threshold, as shown in Table 1. In other words, both the number of fans to be used in cooling of the three fans 101, 102, and 103 and the rotational speed of at least one of the fans to be used are increased in the image forming apparatus 10 when the maximum abrasion amount W exceeds the threshold in the case of the job of the single-sided outputting.

In this manner, the cooling operation is performed with the more excellent cooling efficiency as the abrasion amount of the developer carrier 11 (see FIG. 2) is larger in the image forming apparatus 10.

In the present exemplary embodiment, when the user designates the job of the double-sided outputting, the power source board 6 and the entire inside of the image forming apparatus 10 are cooled with the maximum cooling efficiency obtained by using all of the three fans 101, 102, and 103 irrespective of the abrasion of the developer carrier 11 (see FIG. 2). However, this is a safety reflecting that the load exerted on the power source board 6 is generally large in the case of the double-sided outputting. According to the present invention, when the load exerted on the power source board 6 is not always large even in the case of the double-sided outputting for the reason such as the small number of output sheets required by the job, another cooling efficiency control for the double-sided outputting may be adopted as follows: the power source board 6 and the entire inside of the image forming apparatus 10 are cooled with a low cooling efficiency by the three fans 101, 102, and 103 when the maximum abrasion amount W does not exceed the threshold whereas the power source board 6 and the entire inside of the image forming apparatus 10 are cooled with the maximum cooling efficiency obtained by using all of the three fans 101, 102, and 103 when the maximum abrasion amount W exceeds the threshold.

An effect of the control of the cooling efficiency of the fans 101, 102, and 103 according to the abrasion amount of the developer carrier 11 (see FIG. 2) is explained below based on a specific experiment.

In the experiment, color images, each having image density in which each of the colors of black (K), cyan (C), magenta (M), and yellow (Y) is 5%, are output for five days in 10,000 sheets per day by using a double-sided outputting color printer (i.e., outputting 50,000 sheets in total). Here, 10,000 sheets per day are output by alternately a job for outputting 1,000 sheets by single-sided outputting and a job for outputting 1,000 sheets by double-sided outputting in high-temperature and high-humidity environment in which the temperature is 30° C. and the humidity is 65%. The double-sided outputting color printer used in the experiment is explained in the Example and Comparative Example below.

EXAMPLE

The color printer used in the Example has the same configuration as that of the image forming apparatus 10 shown in FIG. 1, and further, its fan cooling efficiency is controlled according to a maximum abrasion amount out of the abrasion amounts of the four developer carriers, as described above. Specifically, the fan is controlled in the way shown in Table 1 above.

In the color printer used in the Example, the size (i.e., the area) of each of the first fan 101, the second fan 102, and the third fan 103 is about 60 $cm^2$. To the first fan 101 is applied a first predetermined voltage of 20V during the low-speed rotation; in contrast, a second predetermined voltage of 24V during the high-speed rotation. In the case of the rotations of the second fan 102 and the third fan 103, the third and fourth predetermined voltages of 24V are applied to the second fan 102 and the third fan 103, respectively. Moreover, in the color printer used in the Example, the constants $w_1$ and $w_2$ in the equation (1) above are set to 50 pm and 20 pm, respectively. In addition, k in the equation (1) above, which depends upon the temperature inside of the color printer, is "1" in the case where the temperature is lower than 12° C. whereas "0.8" in the case where the temperature is 12° C. or higher.

In the color printer used in the Example, the accumulative number of rotation $r_1$ in the electrically charged state and the accumulative number of rotation $r_2$ in the stopped state of the electric charging are determined according to the number of jobs, the output mode (double-sided outputting or single-sided outputting) in each of the jobs, and the output number of sheets in each of the jobs. In the color printer incorporating four new developer carriers used in the Example, when the color images are formed by alternately repeating a job of outputting 1,000 sheets by single-sided outputting and a job of outputting 1,000 sheets by double-sided outputting in the environment of a temperature of 30° C., like in the experiment, the abrasion amount Win Equation (1) above reaches the threshold in the number of output sheets of about 75,000.

In the experiment above, there is prepared the color printer which incorporates the four new developer carriers for the colors, and then, outputs 50,000 sheets, like the experiment. The experiment is carried out by using the color printer. In this manner, abrasion occurs in each of the developer carriers when the number of output sheets reaches about 25,000 which is half of the number of output sheets of 50,000 in the experiment. Thus, the effect of the cooling efficiency control of the fan according to the abrasion amount in the experiment may be confirmed.

COMPARATIVE EXAMPLE

A color printer in the Comparative Example has the same configuration of that of the image forming apparatus 10 shown in FIG. 1 except the cooling efficiency control of the fan irrespective of the abrasion amount of a developer carrier. Specifically, the color printer in the Comparative Example controls the cooling efficiency of three fans (identical to those of the three fans 101, 102, and 103 shown in FIG. 1) according to a way shown in Table 2 below.

TABLE 2

| | | Small abrasion amount | | Large abrasion amount | |
|---|---|---|---|---|---|
| | Purpose | Single-sided output | Double-sided output | Single-sided output | Double-sided output |
| 1st fan | To cool power source board | Rotation at low speed | Rotation at high speed | Rotation at low speed | Rotation at high speed |
| 2nd fan | To cool inside of apparatus | No rotation | Rotation | No rotation | Rotation |
| 3rd fan | To cool inside of apparatus | No rotation | Rotation | No rotation | Rotation |

For the easy comparison with Table 1 showing the way of control by the color printer in the Example, Table 2 shows the contents of controls in which the abrasion amounts of the developer carrier are "small" and "large." As is obvious from Table 2, the contents of the controls of the three fans in the column of "small" are identical to the contents of the controls of the three fans in the column of "large". Furthermore, the contents of the controls are identical to the contents of the controls of the three fans in the column of "small" in Table 1 in the color printer in the Example.

[Results of Experiment]

The above-described experiment is carried out in the color printer in the Example and the color printer in the Comparative Example. In the color printer in the Comparative Example, the image density is degraded in the fifth day, so that the image becomes poor in quality. Upon examination of the inside state of the color printer in the Comparative Example, the toner is fixed near the auger inside of the developing device for each of the colors. In view of this, the poor quality of the image is construed to be caused by clogging of the toner due to the fixture of the toner.

In contrast, no deficient image is formed for five days in the color printer in the Example. Upon examination of the inside state of the color printer in the Example after the output of 50,000 sheets, it is revealed that no toner is fixed inside of any of the developing devices and the toner may be excellently supplied by the auger.

From the above-described experiment, the cooling efficiency of the fan is controlled according to the abrasion amount, it is concluded that the toner may be avoided from being fixed so that the image of a good quality may be formed.

The description is given above of the exemplary embodiment according to the present invention.

Although the double-sided outputting color printer is exemplified above, the image forming apparatus according to the present invention may be applied to a single-sided outputting color printer. Otherwise, the present invention may be applied to a monochromatic single-sided outputting printer or monochromatic double-sided outputting printer. Alternatively, the present invention may be applied to a copying machine or a facsimile, besides the printer.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cooling device that cools the inside of an image forming apparatus provided with a developer carrier that carries an image developed with a developer while being rotated, the cooling device comprising:

a counting unit that counts an accumulative number of rotation of the developer carrier;

a fan that cools the inside of the image forming apparatus;

a calculating unit that calculates an abrasion amount of the developer carrier in which the accumulative number of rotation counted by the counting unit is used as at least one variable; and a controlling unit that actuates the fan with cooling efficiency according to the abrasion amount calculated by the calculating unit.

2. The cooling device according to claim 1, wherein the image forming apparatus includes a charger that electrically charges the developer carrier in contact with the developer carrier;

the counting unit counts the accumulative number of rotation of the developer carrier divided into a first accumulative number of rotation that is an accumulative number of rotation of the developer carrier being electrically charged by the charger and a second accumulative number of rotation that is an accumulative number of rotation of the developer carrier whose electric charging is being stopped; and the calculating unit calculates the abrasion amount of the developer carrier by using both of the first accumulative number of rotation and the second accumulative number of rotation as variables.

3. The cooling device according to claim 2, wherein the controlling unit actuates the fan with a higher cooling efficiency as the abrasion advances according to the abrasion amount calculated by the calculating unit.

4. The cooling device according to claim 3, wherein the fan is rotatable selectively at a relatively high speed or a relatively low speed according to control for the fan, and the controlling unit rotates the fan at the relatively low speed when the abrasion amount calculated by the calculating unit is a threshold or smaller whereas at the relatively high speed when the abrasion amount exceeds the threshold.

5. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 4.

6. The cooling device according to claim 3, wherein there are provided a plurality of fans, and the controlling unit rotates a relatively small number of fans when the abrasion amount calculated by the calculating unit is a threshold or smaller whereas it rotates a relatively large number of fans when the abrasion amount exceeds the threshold.

7. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 6.

8. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 3.

9. The cooling device according to claim 2, wherein the calculating unit calculates the abrasion amount W of the developer carrier in accordance with the following equation:

$$W=(r_1\times w_1+r_2\times w_2)\times k$$

where $r_1$ designates the first accumulative number of rotation; $r_2$, the second accumulative number of rotation; $w_1$, a constant representing the abrasion amount when the developer carrier being electrically charged is rotated once; $w_2$, a constant representing the abrasion amount when the developer carrier whose electric charging is stopped is rotated once; and k, a predetermined constant determined by a temperature inside of the image forming apparatus.

10. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 9.

11. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 2.

12. The cooling device according to claim 1, wherein the controlling unit actuates the fan with a higher cooling efficiency as the abrasion advances according to the abrasion amount calculated by the calculating unit.

13. The cooling device according to claim 12, wherein the fan is rotatable selectively at a relatively high speed or a relatively low speed according to control for the fan, and the controlling unit rotates the fan at the relatively low speed when the abrasion amount calculated by the calculating unit is a threshold or smaller whereas at the relatively high speed when the abrasion amount exceeds the threshold.

14. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 13.

15. The cooling device according to claim 12, wherein there are provided a plurality of fans, and the controlling unit rotates a relatively small number of fans when the abrasion amount calculated by the calculating unit is a threshold or smaller whereas it rotates a relatively large number of fans when the abrasion amount exceeds the threshold.

16. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 15.

17. An image forming apparatus that subjects a rotating developer carrier to electric charging, formation of an electrostatic latent image, and development, so as to form a development image on the developer carrier, and then, to transfer and fix the development image onto a sheet, the image forming apparatus comprising:

the cooling device according to claim 12.

18. An image forming apparatus that subjects a rotating developer carrier to electric charging, formation of an electrostatic latent image, and development, so as to form a development image on the developer carrier, and transfers and fixes the development image onto a sheet, the image forming apparatus comprising:

the cooling device according to claim 1.

* * * * *